US011837140B2

(12) United States Patent
Zuena et al.

(10) Patent No.: US 11,837,140 B2
(45) Date of Patent: Dec. 5, 2023

(54) CHROMATIC AMBIENT LIGHT CORRECTION

(71) Applicant: Dolby Laboratories Licensing Corporation, San Francisco, CA (US)

(72) Inventors: Jake William Zuena, San Jose, CA (US); Jaclyn Anne Pytlarz, Santa Clara, CA (US); Robin Atkins, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 17/996,210

(22) PCT Filed: Apr. 16, 2021

(86) PCT No.: PCT/US2021/027826

§ 371 (c)(1),
(2) Date: Oct. 13, 2022

(87) PCT Pub. No.: WO2021/212072

PCT Pub. Date: Oct. 21, 2021

(65) Prior Publication Data

US 2023/0196963 A1 Jun. 22, 2023

Related U.S. Application Data

(60) Provisional application No. 63/011,387, filed on Apr. 17, 2020.

(30) Foreign Application Priority Data

Apr. 17, 2020 (EP) ..... 20170054

(51) Int. Cl.
*G09G 3/20* (2006.01)
*G09G 5/02* (2006.01)

(52) U.S. Cl.
CPC ..... *G09G 3/2003* (2013.01); *G09G 5/02* (2013.01); *G09G 2320/0666* (2013.01);
(Continued)

(58) Field of Classification Search
CPC ..... G09G 3/2003; G09G 5/02; G09G 2320/0666; G09G 2340/06; G09G 2360/144; G09G 2360/16
(Continued)

(56) References Cited

U.S. PATENT DOCUMENTS 9,842,530 B2 12/2017 Carlsson
9,947,275 B1 4/2018 Ramanath
(Continued)

FOREIGN PATENT DOCUMENTS

EP 1009161 B1 6/2000
EP 3021315 B1 5/2016
(Continued)

OTHER PUBLICATIONS

Choi, K. et al "True White Point for Television Screens Across Different Viewing Conditions" IEEE Transactions on Consumer Electronics, vol. 64, No. 3, Aug. 2018, pp. 292-300.
(Continued)

*Primary Examiner* — Tom V Sheng

(57) ABSTRACT

Methods and systems for chromatic ambient-light support are provided. Given an input surround correlated color temperature (CCT), its normalized value is mapped to a preferred gray CCT value using a sigmoid-like function model generated based on viewer experimental data. The preferred gray CCT value is then mapped to an adjusted CCT value so that viewing conditions on a display with the input surround CCT value match a D65 surround CCT value.

13 Claims, 2 Drawing Sheets

(52) U.S. Cl.
CPC ... *G09G 2340/06* (2013.01); *G09G 2360/144* (2013.01); *G09G 2360/16* (2013.01)

(58) Field of Classification Search
USPC ..... 345/690
See application file for complete search history.

(56) References Cited

U.S. PATENT DOCUMENTS

| | | | | |
|---|---|---|---|---|
| 10,264,231 | B2 | 4/2019 | Kring | |
| 10,306,729 | B2 | 5/2019 | Chen | |
| 10,410,590 | B2 | 9/2019 | Comps | |
| 10,546,524 | B2 | 1/2020 | Bell | |
| 10,586,482 | B1 | 3/2020 | Yung | |
| 10,600,166 | B2 | 3/2020 | Pytlarz | |
| 2008/0285851 | A1* | 11/2008 | Wu | H04N 9/73 382/167 |
| 2016/0005153 | A1* | 1/2016 | Atkins | H04N 1/60 345/591 |
| 2017/0205977 | A1* | 7/2017 | Fertik | G06F 3/0483 |
| 2017/0238062 | A1 | 8/2017 | Oh | |
| 2017/0263174 | A1* | 9/2017 | Chen | G09G 5/02 |
| 2017/0345390 | A1* | 11/2017 | Orio | G09G 5/06 |
| 2018/0013927 | A1* | 1/2018 | Atkins | H04N 9/68 |
| 2018/0025464 | A1 | 1/2018 | Yeung | |
| 2018/0234704 | A1* | 8/2018 | Atkins | H04N 9/68 |
| 2018/0315365 | A1* | 11/2018 | Wu | G09G 3/2003 |
| 2019/0172382 | A1* | 6/2019 | Bell | G09G 3/007 |
| 2019/0266976 | A1* | 8/2019 | Wyble | G06F 3/147 |
| 2019/0266977 | A1* | 8/2019 | Ward | G09G 3/3208 |
| 2019/0278323 | A1 | 9/2019 | Aurongzeb | |
| 2019/0325802 | A1* | 10/2019 | Aly | G09G 5/005 |
| 2019/0362688 | A1 | 11/2019 | Wang | |
| 2020/0029061 | A1 | 1/2020 | Sarkar | |
| 2020/0074959 | A1 | 3/2020 | Bhat | |
| 2020/0105225 | A1* | 4/2020 | Greenebaum | G09G 3/2003 |
| 2020/0251039 | A1* | 8/2020 | Mandle | G09G 3/2003 |
| 2021/0174728 | A1* | 6/2021 | Bogdanowicz | G09G 3/2003 |
| 2021/0264874 | A1* | 8/2021 | Chen | G09G 5/02 |
| 2021/0287586 | A1* | 9/2021 | Hung | G09G 3/2003 |
| 2021/0295762 | A1* | 9/2021 | Mandle | G02F 1/133514 |
| 2021/0312882 | A1* | 10/2021 | Wu | G09G 3/2003 |
| 2021/0398471 | A1* | 12/2021 | Kidoguchi | G09G 5/02 |
| 2022/0051605 | A1* | 2/2022 | Bogdanowicz | G09G 5/10 |
| 2022/0230601 | A1* | 7/2022 | Dachsbacher | G09G 3/2003 |
| 2022/0327982 | A1* | 10/2022 | Pytlarz | G01J 3/465 |
| 2023/0073331 | A1* | 3/2023 | DeFilippis | G02B 27/141 |

FOREIGN PATENT DOCUMENTS

| | | | |
|---|---|---|---|
| JP | 2012114498 | A | 6/2012 |
| KR | 20040035440 | A | 4/2004 |
| WO | 2012125802 | A1 | 9/2012 |

OTHER PUBLICATIONS

Dong, L. et al "The Impact of LED Correlated Color Temperature on Visual Performance Under Mesopic Conditions" IEEE Photonics Society Publication, vol. 9, No. 6, Dec. 2017.

Hernandez-Andres, J. et al "Calculating Correlated Color Temperatures Across the Entire Gamut of Daylight and Skylight Chromaticities" Applied Optics, Sep. 20, 1999, vol. 38, No. 27, pp. 5703-5709.

Li, X. et al "Equalization of Loudspeaker Response Using Balanced Model Truncation" The Journal of the Acoustical Society of America, J. Acoust. Soc. Am 137, Apr. 2015.

McCamy, Calvin S. "Correlated color temperature as an explicit function of chromaticity coordinates," Color Research & Application. 17 (2): 142-144 (Apr. 1992).

White Paper, Dolby, What is ICTCP? Introduction.

Wikipedia, "Color Temperature" Jun. 2012.

Wu, J. et al "Enhanced Viewing Experience Considering Chromatic Adaptation" SID 2019, pp. 857-859.

ITU-R BT.2100-2 "Image Parameter Values for High Dynamic Range Television for Use in Production and International Programme Exchange" Jul. 2018.

* cited by examiner

CHROMATIC AMBIENT LIGHT CORRECTION

CROSS-REFERENCE TO RELATED APPLICATIONS

This application claims priority to European Patent Application No. 20170054.9, filed 17 Apr. 2020 and U.S. Provisional Patent Application 5 No. 63/011,387, filed 17 Apr. 2020.

TECHNOLOGY

The present document relates generally to images and display management. More particularly, an embodiment of the present invention relates to chromatic ambient light correction for displaying images on color displays.

BACKGROUND

During content creation, professionally created content is mastered in a D65 surround light, where D65 refers to the correlated color temperature (CCT) for viewing content, at 6,504 Kelvin (K). When viewing such content in a home environment, even with a perfectly calibrated display, the surrounding (ambient) light may affect how the color in displayed images is perceived.

For example, when a viewer is surrounded by warmer or cooler color temperatures, their human visual system (HVS) shifts its perception of what represents white and neutral gray. The HVS achieves near-complete adaptation to the new surround after being exposed to it for one minute. This phenomenon can pose a problem when observers are viewing D65-mastered content in surrounds of CCT other than D65. If the observers are adapted to alternative color temperatures, the D65-mastered content will not appear the same as it did when the observers were adapted to the standard, D65, color temperature. This prevents the creator's intent from being represented properly and causes an unpleasant viewing experience. As appreciated by the inventors here, improved techniques for chromatic ambient light correction for preserving the intended appearance of content when it is presented in environments with lights of non-standard color temperatures, are desired.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF THE DRAWINGS

An embodiment of the present invention is illustrated by way of example, and not in way by limitation, in the figures of the accompanying drawings and in which like reference numerals refer to similar elements and in which.

DESCRIPTION OF EXAMPLE EMBODIMENTS

Example embodiments that relate to chromatic ambient-light correction are described herein. In the following description, for the purposes of explanation, numerous specific details are set forth in order to provide a thorough understanding of the various embodiments of present invention. It will be apparent, however, that the various embodiments of the present invention may be practiced without these specific details. In other instances, well-known structures and devices are not described in exhaustive detail, in order to avoid unnecessarily occluding, obscuring, or obfuscating embodiments of the present invention.

SUMMARY

Example embodiments described herein relate to ambient-light correction for improved viewing experience. In an embodiment, a system with a processor receives images mastered in D65 surround light. The processor receives a surround correlated color temperature (CCT) value, normalizes the surround CCT value to generate a normalized CCT value, applies a function model to the normalized CCT value to generate a preferred gray CCT value, wherein the function model comprises a sigmoid function with an approximately linear mapping for a range of normalized surround values between 5,000 and 10,000 K, adjusts the preferred gray CCT value to generate an adjusted CCT value matching a D65 surround perceived CCT value, generates a diagonal transformation matrix based on LMS components of the adjusted CCT value, and for input image data in an LMS color space, generates transformed LMS image data by applying the diagonal transformation matrix to the input image data.

Example Video Delivery Processing Pipeline

Figure 1:
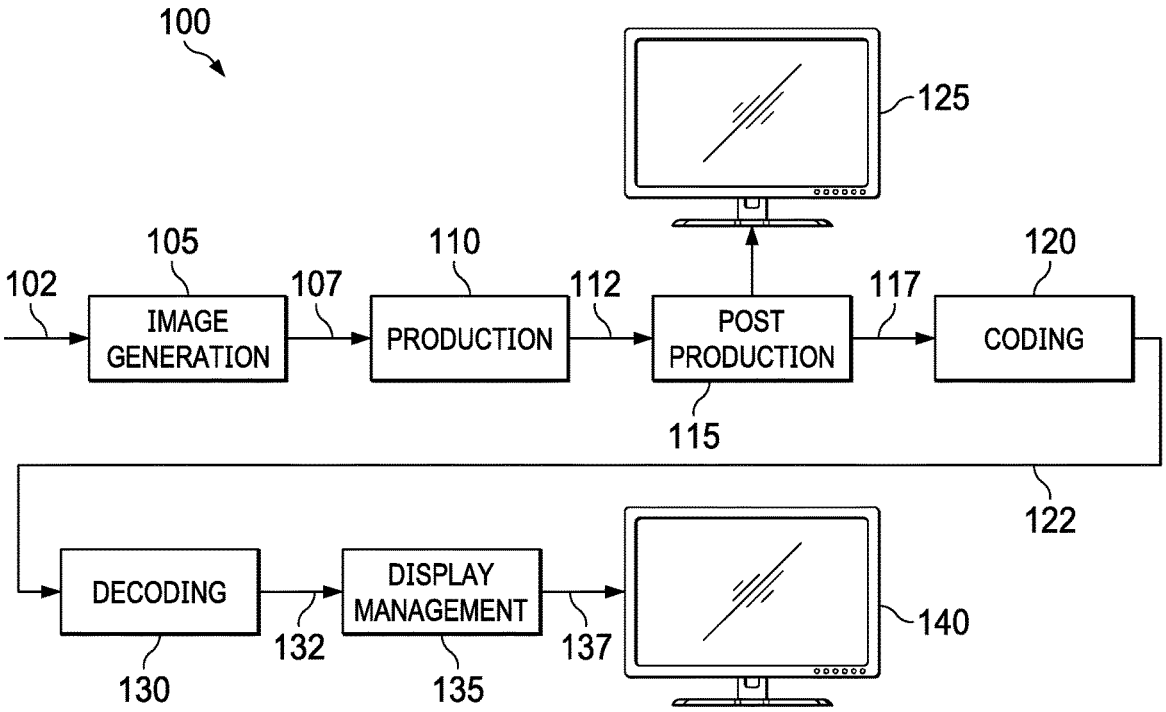
FIG. 1 depicts an example process for a video delivery pipeline.

FIG. 1 depicts an example process of a conventional video delivery pipeline (100) showing various stages from video capture to video content display. A sequence of video frames (102) is captured or generated using image generation block (105). Video frames (102) may be digitally captured (e.g. by a digital camera) or generated by a computer (e.g. using computer animation) to provide video data (107). Alternatively, video frames (102) may be captured on film by a film camera. The film is converted to a digital format to provide video data (107). In a production phase (110), video data (107) is edited to provide a video production stream (112).

The video data of production stream (112) is then provided to a processor at block (115) for post-production editing. Block (115) post-production editing may include adjusting or modifying colors or brightness in particular areas of an image to enhance the image quality or achieve a particular appearance for the image in accordance with the video creator's creative intent. This is sometimes called "color timing" or "color grading." Other editing (e.g. scene selection and sequencing, image cropping, addition of computer-generated visual special effects, judder or blur control, frame rate control, etc.) may be performed at block (115) to yield a final version (117) of the production for distribution. During post-production editing (115), video images are viewed on a reference display (125).

Following post-production (115), video data of final production (117) may be delivered to encoding block (120) for delivering downstream to decoding and playback devices such as television sets, set-top boxes, movie theaters, and the like. In some embodiments, coding block (120) may include audio and video encoders, such as those defined by ATSC, DVB, DVD, Blu-Ray, and other delivery formats, to generate coded bit stream (122). In a receiver, the coded bit stream (122) is decoded by decoding unit (130) to generate a decoded signal (132) representing an identical or close approximation of signal (117). The receiver may be attached to a target display (140) which may have completely different characteristics than the reference display (125). In that case, a display management block (135) may be used to map the dynamic range of decoded signal (132) to the characteristics of the target display (140) by generating display-mapped signal (137).

Chromatic Ambient Light Correction

When images or video are displayed on a display, it is desired for the image content to look as the creators intended, regardless of the CCT of the surrounding light. It is possible to alter the white point of an image to something other than D65; however, simply adapting the image to the CCT of the environment's surround yields results that are more displeasing than leaving the image in its original D65 state.

In an embodiment, in order to find the appropriate amount of compensation needed to combat observer adaptation to different surrounds, an experiment was run to assess the perception of neutral gray and how it changes in environments of different CCTs. From the results of this experiment, a function model was established between the input surround CCT and the CCT of the preferred neutral. Careful consideration was taken when building this function to ensure that it is monotonically increasing, continuous in its derivative, and rolls off at lower and upper boundaries. An example of such a function and experimental data points are shown in FIG. 2.

Figure 2A:
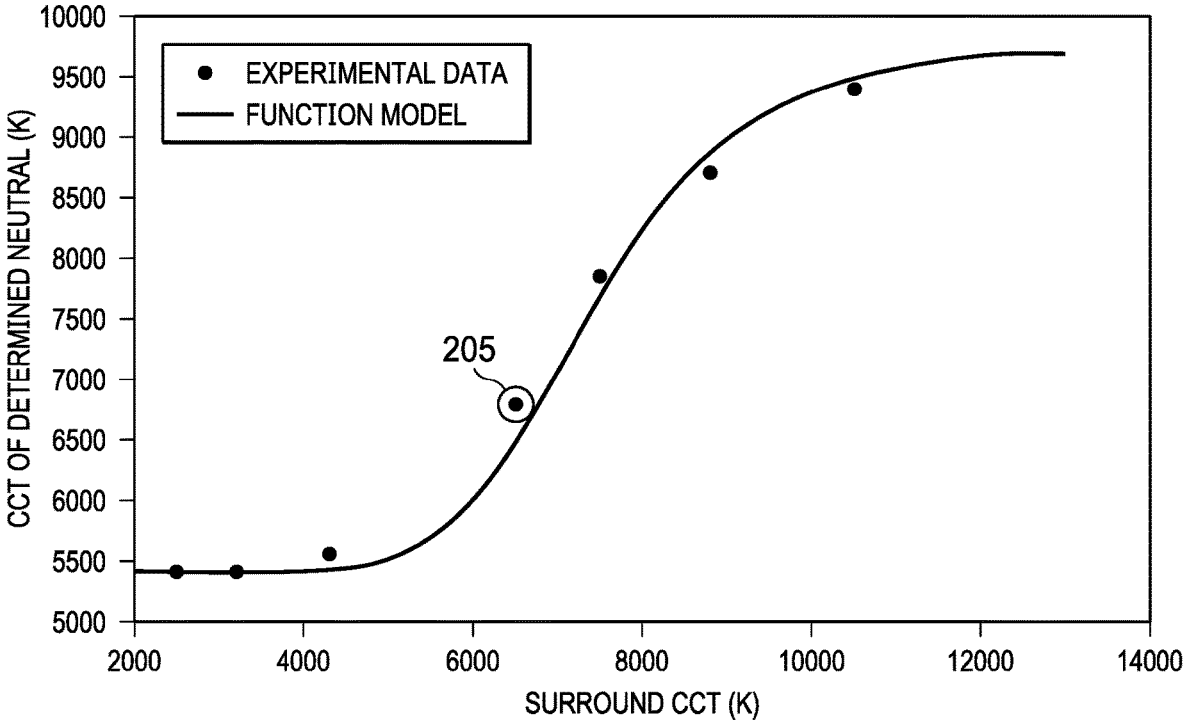
FIG. 2 depicts a function model of the CCT of perceived neutral gray given surround CCT, according to an embodiment of this invention.
Figure 2B:
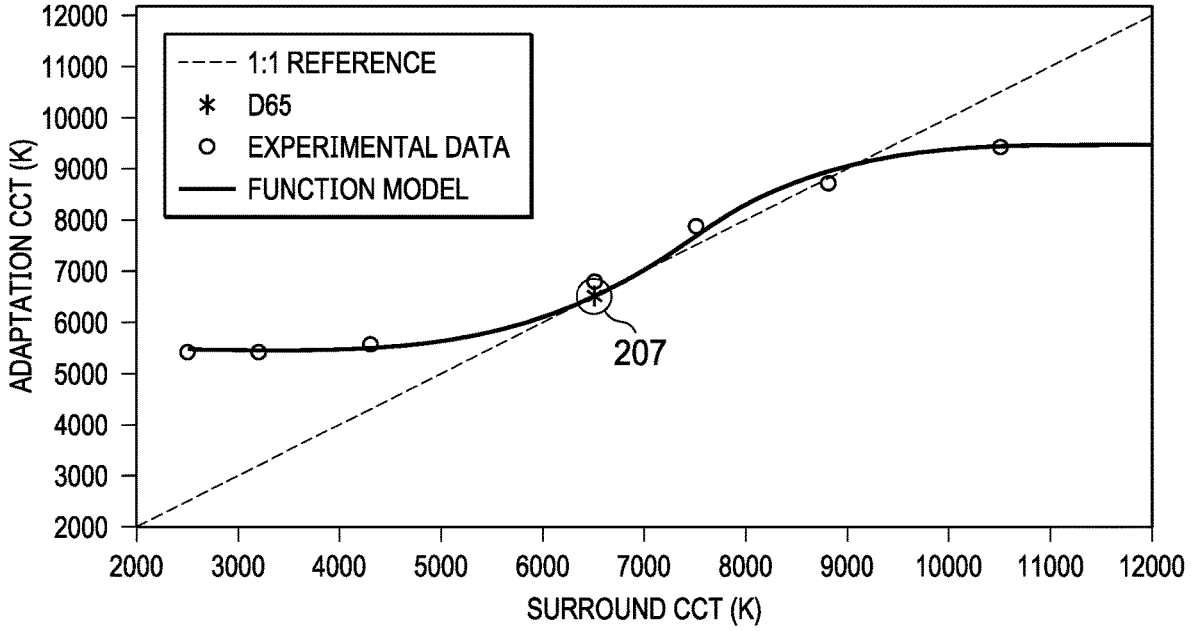

FIG. 2 describes the CCT that participants of an experiment believed to be neutral when present in surrounds of various CCTs. The curve shown is derived from the experimental results. Warmer input surround CCTs are heavily compensated for and result in output, "determined neutral" CCTs, above 5,000 Kelvin. Mid-range input CCTs follow a trend that is mostly linear. Cooler input CCTs are compensated for in the curve, though, considerably less-so than their warmer counterparts. Construction of this curve followed three major features. First, the curve is monotonically increasing throughout its operating range, [2,000 K, 12,500 K]. Second, the curve is invertible. Third, the curve rolls off to its boundaries.

In an example embodiment, chromatic ambient -light correction is enabled in conjunction with an ambient-light sensor which can read the CCT of the environment and returns its value in either [x, y] chromaticity coordinates or directly in surround CCT values (in Kelvin). For example, without limitation, the sensor may be part of the display itself, a camera, a mobile device, a stand-alone sensor, and the like.

As an example, surround light [x, y] chromaticity coordinates may be translated to surround CCT (in Kelvin) using McCamy's approximation or other techniques known in the art (see, Wikipedia article on "Color Temperature" or McCamy, Calvin S. (April 1992). "*Correlated color temperature as an explicit function of chromaticity coordinates,*" Color Research & Application. 17 (2): 142-144, incorporated herein by reference.)

In an embodiment, given the CCT surround value, denoted as $CCT_s$, the value may be normalized between 2,500 K and 10,500 K to match the boundaries tested in the experiment to derive the function model of FIG. 2. In an embodiment, such a normalization comprises:

$$CCT_n = \min\left(\left(\frac{12{,}500-2{,}000}{10{,}500-2{,}500}\right), \left(\frac{CCTs}{10{,}500-2{,}500}\right)\right), \tag{1}$$

As depicted in equation (1), in an embodiment, additional considerations are also taken into account during this normalization, for example, the CCT boundary values used to translate [x, y] chromaticity values to CCT values, e.g., 2,000 K in the low end and 12,500 K in the high end.

For the sake of clarity, the term "normalization" is herein to be understood as adjusting input values to a common scale, i.e. a norm. For instance, as above, $CCT_s$ may be adjusted to a scale from 2,500 K to 10,500 K. The adjustment of the input values can be made in different ways, e.g. removing outlier data, rescaling or more sophistically align the input values to a pre-set scale.

Given $CCT_n$ values, CCT functional values, denoted as $CCT_f$, may be computed using the function model of FIG. 2, which, in an embodiment, may be approximated as $$CCT_f(CCT_n) = \frac{c1 * CCT_n^{C2}}{1 + (c1-1) * CCT_n^{C2}} * 4096 + 5{,}421, \tag{2}$$

where c1=14.4492 and c2=5.3723. The value of 5,421 represents the lower possible functional CCT value.

Given $CCT_f$ values, they are adjusted so that given an input mastered using CCT D65 the display output is also perceived as being under D65 surround (6,504 K). In an embodiment the adjusted CCT values, denoted as $CCT_a$, can be computed as:

$$CCT_a = CCT_f(CCT_n) - CCT_f(6{,}504) + 6{,}504. \tag{3}$$

In an embodiment, to reduce the effects in viewing conditions on any rapid changes in the ambient-light sensor, the adjusted CCT values may be filtered using a low pass filter or any other equalization filter known in the art. This filter may use the median CCT value sensed over time to bypass short and vastly-different CCT changes that may have been interpreted by the sensor. For example, if a consumer is watching television in a warm surround and, for a brief moment, shines a cool-colored flashlight on the sensor, the IIR filter will recognize the flashlight CCT value as a spike in the returned data and ignore that inconsistency when processing images for display in the warm surround. Furthermore, if there is not enough ambient light, for example, if it falls below 5 nits, then it may be deemed that there is no reason to perform chromatic ambient-light correction and the adapted CCT of the image will slowly ease towards the standard D65.

This CCT equalization problem may be considered analogous to the problem of loudspeaker equalization in audio processing. For example, as described in "Equalization of loudspeaker response using balanced model truncation, by X. Li et al., The Journal of the Acoustical Society of America 137, EL241 (2015); doi: 10.1121/1.4914946, one can design an IIR filter modeling a speaker's ideal response. A similar filter can also be used for filtering the adjusted CCT calues.

In an embodiment, the chromatic ambient-light correction is applied to images to be displayed in the long, medium, short (LMS) domain, as a scaler on L, M, and S, i.e. a color space representing three types of cones of the human eye named after their responsivity. For example, in an embodiment, $$\begin{bmatrix} L \\ M \\ S \end{bmatrix}_{adapted} = \begin{bmatrix} \alpha & 0 & 0 \\ 0 & \beta & 0 \\ 0 & 0 & \gamma \end{bmatrix} * \begin{bmatrix} L \\ M \\ S \end{bmatrix}, \tag{4}$$

where $$\alpha = [\text{L of } CCT_a]/[\text{L of D65}]$$

$$\beta = [\text{M of } CCT_a]/[\text{M of D65}],$$

$$\gamma = [\text{S of } CCT_a)]/[\text{S of D65}] \tag{5}$$

In an embodiment, to convert CCT values to LMS values, the CCT values are first converted to chromaticity [x, y] values (e.g., via a table look-up) and then to the XYZ color space. For example, the [x, y] to XYZ conversion may comprise:

$$X = \frac{x}{y}$$

$$Y = \frac{y}{y}$$

$$Z = \frac{(1 - x - y)}{y}$$

Next, the XYZ values are linearly transformed to LMS via the Hunt-Pointer-Estevez matrix based on the physiological cone primaries. The values of this matrix are normalized to the D65 white point. In an embodiment, for data in the ICtCp color space, a cross-talk optimization matrix is applied to ensure more constant hue performance $$\begin{bmatrix} L \\ M \\ S \end{bmatrix} = \begin{bmatrix} 0.92 & 0.04 & 0.04 \\ 0.04 & 0.92 & 0.04 \\ 0.04 & 0.04 & 0.92 \end{bmatrix} * \begin{bmatrix} 0.4002 & 0.7076 & -0.0808 \\ -0.2263 & 1.1653 & 0.0457 \\ 0 & 0 & 0.9182 \end{bmatrix} * \begin{bmatrix} X \\ Y \\ Z \end{bmatrix}. \tag{6}$$

Within this calculation, the LMS values of D65 are all 1.0. This comes from how the Hunt-Pointer-Estevez matrix is normalized to the D65 white point.

$$\begin{bmatrix} L \\ M \\ S \end{bmatrix}_{D65} = \begin{bmatrix} 1 \\ 1 \\ 1 \end{bmatrix}. \tag{7}$$

For example, in many display-related processes, for more efficient processing, input data may be converted from their original color space (e.g., RGB or YCbCr) to the ICtCp color space. Such conversion relies on translating the input color space using an input-color-to LMS color transformation (e.g., RGB to LMS). Thus, in such systems, for proper chromatic ambient-light correction, during color transformation, the LMS output is translated to the adapted-LMS values, as given by equation (4). Examples of color transformations between color spaces for both PQ and HLG-coded data may be found in Rec. BT. 2100, "Image parameter values for high dynamic range television for use in production and international programme exchange," by ITU, which is incorporated herein by reference in its entirety.

Additional Considerations

The sizes of the surround environment and of the display itself also influence the adaptation state of the viewer. As the size of the screen encompasses more of the visual field, the adaptation state may be more influenced by the source image itself. In an embodiment, for chromatic compensation, one may use a blend of the surround CCT and the source image CCT. Depending on the visual angle of the target display, compared to the reference environment, the source image CCT may drive the amount of reduced amount of chromatic compensation. In the case where the visual field of the target environment is greater than the visual field of the source environment, the chromatic adaptation should be shifted away from the image, towards D65. In the case where the visual field of the target is less than the visual field of the source, the chromatic adaptation should be driven towards the CCT of the source.

$\alpha_{et}$ ab denote a blending parameter in [0,1] to be used to adjust chroma adaptation based on the difference between the source viewing angle (SVA) and the target viewing angle (TVA), then, in an embodiment, a blended CCT value, denoted as $CCT_b$ , may be generated as:

if SVA<TVS $$CCT_b = CCT_a * \alpha_b + CCT_{source} * (1 - \alpha_b),$$

else $$CCT_b = CCT_a * \alpha_b + CCT_{D65} * (1 - \alpha_b). \tag{8}$$

In an embodiment, the source viewing angle may be described in the input data, e.g., using metadata. The target viewing angle may be computed using the size of the display and the picture-height distance of the observer from the screen. For example, without limitation, in an embodiment, for an observer at three picture heights from the screen, $\alpha_b = 1$. This value may change when he is closer or further way. In essence, as shown in equation (8), when the viewer is closer to the screen, then blending takes into consideration the CCT of the source to be displayed, and when the viewer is further away from the screen, then blending is based on the CCT of D65. The CCT source value may be computed by finding the average (x, y) chromaticity of the image pixels and converting that average value to a CCT value. Alternatively, the value of CCT source can be communicated to the receiver (or the display) using metadata.

As noted earlier, in an embodiment, the $CCT_a$ value in equation (8) may also be replaced with a filtered version of the $CCT_a$ values to avoid abrupt changes.

As described in U.S. Pat. No. 10,600,166, "Tone curve mapping for high dynamic range images," by J. A. Pytlarz and R. Atkins, which is incorporated herein by reference, in many display applications, source data in a first dynamic range may be mapped to a display with a different dynamic range using a tone mapping curve. For example, image data with luminance values in [Smin, Smax] may be tone-mapped to a display with a dynamic range [Tmin, Tmax], wherein Tmin and Tmax denote the lowest black and maximum white values that can be displayed (e.g., in nits).

To prevent the manifestation of clipping artifacts during this tone mapping operation, it is helpful to also lower the mapped peak luminance of images during tone mapping, typically by lowering Tmax. In an embodiment, this change in Tmax luminance is calculated by taking the RGB to XYZ matrices of the target-adapting white point and the display white point and converting between the two. This ensures that the RGB components will have enough headroom to not be clipped. For example, in an embodiment a new Tmax value (newTmax) is computed as:

$$\text{ratio} = RGBtoXYZ_{Target} * RGBtoXYZ^{-1}_{Display}, \tag{9}$$

$$percChange = \frac{\text{ratio}}{\max(\text{ratio})} * RGBtoY_{Target},$$

$$newT\max = percChange * T\max.$$

In equation (9), $RGBtoXYZ_{Target}$ denotes the 3×3 phosphor matrix constructed from the red, green, blue, and white primaries of the target white point, $RGBtoXYZ_{Display}$ denotes the 3×3 phosphor matrix constructed from the display primaries, and $RGBtoXYZ^{-1}{}_{Display}$ denotes its inverse. The parameter max(ratio) denotes the maximum value of the diagonal in the ratio matrix. RGBtoY Target denotes the Y values of the $RGBtoXYZ_{Target}$ matrix (e.g., a 3×1 matrix). The white primary used to create the $RGBtoXYZ_{Target}$ matrix is directly based of the blended CCT value ($CCT_b$) (e.g., see equation (8)).

To prevent unnecessary darkening, in an embodiment, this feature may be adjusted based on the content of the image. For instance, dark images may not need the extra headroom, and darkening the image may result in a loss of detail. Therefore, the adjustment to Tmax may also be dependent on the image's Smax. In some embodiments, the image's average luminance value, denoted by Smid, may also give a better indication of the importance of dark vs bright detail and decisions may be made accordingly; after all, the desired goal of the image processing is to preserve the original appearance of the image under its mastered conditions. For example, instead of using equation (9) to adjust Tmax, in an alternative embodiment:

$$\text{ratio} = RGBtoXYZ_{Target} * RGBtoXYZ^{-1}_{Display} \tag{10}$$

$$percChange = \frac{\text{ratio}}{\max(\text{ratio})} * RGBtoY_{Target},$$

$$\text{if } percChange < \frac{S\max}{T\max}$$

$$percChange = 1$$

$$newT\max = percChange * T\max.$$

Figure 3:
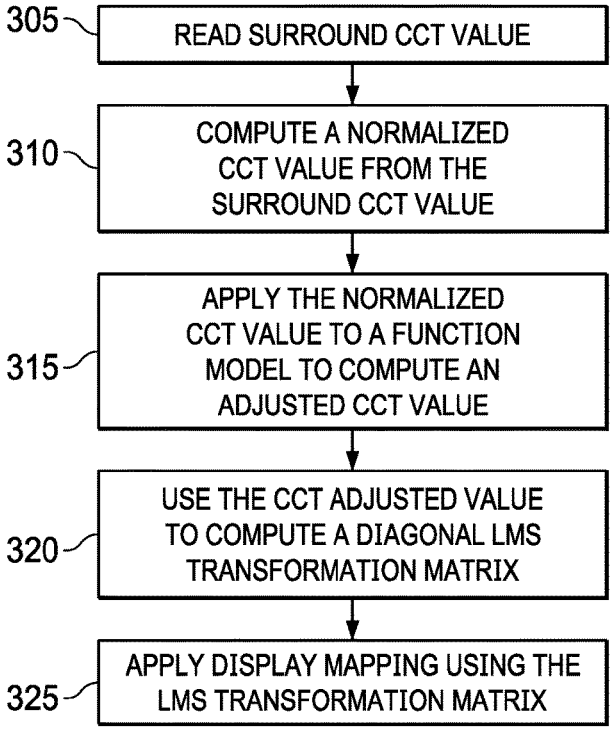
FIG. 3 depicts an example processing pipeline for chromatic ambient-light correction according to an embodiment of this invention.

FIG. 3 depicts an example process pipeline for chromatic ambient-light correction according to an embodiment. As depicted in FIG. 3, in step 305, one reads (or computes) the surround CCT value. If the surround value is outside of CCT-related system constrains used to develop the chromatic correction model, then, in step 310, the surround CCT value may be normalized to generate a normalized CCT value (e.g., see equation (1)). In step 315, the normalized CCT value is used to map it to a CCT neutral gray value, or a functional CCT value. In an embodiment, as depicted by FIG. 2, this mapping may be approximated by a sigmoid-like function based on experimental data, where very cool (e.g., below 5,000 K) and very warm (e.g., above 10,500 K) input CCT values are compensated considerably less-so than mid-temperatures (e.g., between 5,000 and 10,000 K). The mapping can be done using a parametric representation (e.g., equation (2)), a table look-up, or other suitable mappings known in the art. In step 320, the functional CCT values are adjusted one more time (see equation (3)) to generate adjusted CCT values so that input images color-graded under D65 light are also being perceived as being viewed under D65 light. Then, in step 325, the adjusted CCT values are used to compute a new diagonal LMS transformation matrix diag([α β γ]) to be used in step 330 to compute modified LMS values (see equations (4) and (5)).

Example Computer System Implementation

Embodiments of the present invention may be implemented with a computer system, systems configured in electronic circuitry and components, an integrated circuit (IC) device such as a microcontroller, a field programmable gate array (FPGA), or another configurable or programmable logic device (PLD), a discrete time or digital signal processor (DSP), an application specific IC (ASIC), and/or apparatus that includes one or more of such systems, devices or components. The computer and/or IC may perform, control, or execute instructions relating to chromatic ambient-light correction, such as those described herein. The computer and/or IC may compute any of a variety of parameters or values that relate to chromatic ambient-light correction described herein. The image and video embodiments may be implemented in hardware, software, firmware and various combinations thereof.

Certain implementations of the invention comprise computer processors which execute software instructions which cause the processors to perform a method of the invention. For example, one or more processors in a display, an encoder, a set top box, a transcoder or the like may implement methods related to chromatic ambient-light correction as described above by executing software instructions in a program memory accessible to the processors. Embodiments of the invention may also be provided in the form of a program product. The program product may comprise any non-transitory and tangible medium which carries a set of computer-readable signals comprising instructions which, when executed by a data processor, cause the data processor to execute a method of the invention. Program products according to the invention may be in any of a wide variety of non-transitory and tangible forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (e.g., that is functionally equivalent), including components which are not structurally equivalent to the disclosed structure which performs the function in the illustrated example embodiments of the invention.

Equivalents, Extensions, Alternatives and Miscellaneous

Example embodiments that relate to chromatic ambient-light correction are thus described. In the foregoing specification, embodiments of the present invention have been described with reference to numerous specific details that may vary from implementation to implementation. Thus, the sole and exclusive indicator of what is the invention and what is intended by the applicants to be the invention is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

Various aspects of the present invention may be appreciated from the following enumerated example embodiments (EEEs):

EEE1. A method for chromatic ambient-light correction using a processor, the method comprising:

receiving a surround correlated color temperature (CCT) data set;

applying a function model to the surround CCT data set to generate a target gray CCT data set, retrieving a D65 surround perceived CCT data set defining relationships between actual CCT values and user perceived CCT values, adjusting the target gray CCT data set to generate an adjusted CCT data set matching the D65 surround perceived CCT data set, determining long, medium, short (LMS) components based on the adjusted CCT data set, and generating a diagonal transformation matrix based on the LMS components, such that for input image data in and LMS color space, transformed LMS image data is generated by applying the diagonal transformation matrix to the input image data.

EEE2. The method according to EEE1, wherein the function model is based on a sigmoid function with a linear mapping for a range of surround CCT values between 5,000 and 10,000 K, EEE3. The method according to EEE1 or EEE2, further comprising removing outlier data of the surround CCT data set by removing values in the surround CCT data set below a low CCT boundary value and above a high CCT boundary value, EEE4. The method according to any of EEE1 to EEE3, wherein generating the filtered surround CCT data set ($CCT_n$) comprises computing $$CCT_n = \left(\frac{CCT_S}{CCT_H - CCT_L}\right),$$

wherein $CCT_L$ denotes the low CCT boundary value and $CCT_H$ denotes the high CCT boundary value.

EEE5. The method according to any of EEE1 to EEE4, wherein a parametric representation of the function model comprises wherein the step of adjusting the target gray CCT data set to generate the adjusted CCT data set matching the D65 surround perceived CCT data set is made by using a function model having a parametric representation comprising:

$$CCT_f(CCT_n) = \frac{c1 * CCT_n^{c2}}{1 + (c1 - 1) * CCT_n^{c2}} * 4096 + 5{,}421,$$

wherein, $CCT_n$ denotes the surround CCT data set, $CCT_f(CCT_n)$ denotes the target gray CCT data set, c1=14.4492 and c2=5.3723.

EEE6. The method according to any of EEE1 to EEE5, wherein generating the adjusted CCT data set ($CCT_a$) comprises computing $$CCT_a = CCT_f(CCT_n) - CCT_f(6{,}504) + 6{,}504,$$

wherein $CCT_f(x)$ denotes the output of the function model for an input CCT value x, and $CCT_n$ denotes the surround CCT data set.

EEE7. The method according to any of EEE1 to EEE6, wherein generating the diagonal transformation matrix comprises computing $$\alpha = [\text{L of } CCT_a]/[\text{L of D65}]$$

$$\beta = [\text{M of } CCT_a]/[\text{M of D65}],$$

$$\gamma = [\text{S of } CCT_a)]/[\text{S of D65}]$$

wherein $CCT_a$ denotes the adjusted CCT data set, and $\alpha$, $\beta$, and $\gamma$ denote the elements of the diagonal transformation matrix.

EEE8. The method according to any of EEE1 to EEE7, further comprising:

filtering adjusted CCT values with a low-pass filter to generate filtered CCT values and generating the diagonal transformation matrix based on the filtered CCT values.

EEE9. The method according to any of EEE1 to EEE8, further comprising generating a blended CCT value based on the adjusted CCT value, a source-viewing angle (SVA), a target-viewing angle (TVA), and a blending parameter $\alpha_b$; and generating the diagonal transformation matrix based on the blended CCT value.

EEE10. The method according to EEE9, wherein generating the blended CCT value ($CCT_B$) comprises computing $$\text{if SVA} < \text{TVS}$$

$$CCT_b = CCT_a * \alpha_b + CCT_{source} * (1 - \alpha_b),$$

$$\text{else}$$

$$CCT_b = CCT_a * \alpha_b + CCT_{D65} * (1 - \alpha_b)$$

wherein the blending parameter $\alpha_b$ is in in [0,1], $CCT_{source}$ denotes a CCT data set based on the input image data and $CCT_{D65}$ denotes the CCT data set of D65, 6,504 K.

EEE11. The method according to any of EEE1 to EEE10, the method further comprising:

for a tone mapping function mapping the input image data in a source dynamic range [Smin, Smax] to a target display with a target dynamic range [Tmin,Tmax], generating an adjusted Tmax (newTmax) value comprises:

$$\text{ratio} = RGBtoXYZ_{Target} * RGBtoXYZ_{Display}^{-1}$$

$$percChange = \frac{\text{ratio}}{\max(\text{ratio})} * RGBtoY_{Target},$$

$$newT\max = percChange * T\max,$$

wherein, $RGBtoXYZ_{Target}$ denotes a 3×3 phosphor matrix constructed from red, green, blue, and white primaries of a target white point based on the adjusted CCT value, $RGBtoXYZ_{Display}$ denotes a 3×3 phosphor matrix constructed from the target display primaries, max(ratio) denotes the maximum value of the diagonal in the ratio matrix, and $RGBtoY_{Target}$ denotes Y values of the $RGBtoXYZ_{Target}$ matrix.

EEE12. The method according to EEE11, wherein generating the adjusted Tmax (newTmax) value comprises $$\text{ratio} = RGBtoXYZ_{Target} * RGBtoXYZ_{Display}^{-1}$$

$$percChange = \frac{\text{ratio}}{\max(\text{ratio})} * RGBtoY_{Target},$$

$$\text{if } percChange < \frac{S\max}{T\max}$$

$$percChange = 1$$

$$newT\max = percChange * T\max.$$

EEE13. A non-transitory computer-readable storage medium having stored thereon computer-executable instructions for executing with one or more processors a method in accordance with any one of EEE1 to EEE12.

EEE14. An apparatus comprising a processor and configured to perform any one of the methods recited in EEE1 to EEE12.

The invention claimed is:

1. A method for chromatic ambient-light correction using a processor, the method comprising:

receiving a surround correlated color temperature (CCT) value;

normalizing the surround CCT value to generate a normalized CCT value;

applying a function model to the normalized CCT value to generate a preferred gray CCT value, wherein the function model comprises a sigmoid function with an approximately linear mapping for a range of normalized surround values between 5,000 and 10,000 K;

adjusting the preferred gray CCT value to generate an adjusted CCT value matching a D65 surround perceived CCT value;

generating a diagonal transformation matrix based on LMS components of the adjusted CCT value; and for input image data in an LMS color space, generating transformed LMS image data by applying the diagonal transformation matrix to the input image data.

2. The method of claim 1, wherein the surround CCT is normalized according to a low CCT boundary value and a high CCT boundary value.

3. The method of claim 2, wherein generating the normalizing CCT value ($CCT_n$) comprises computing $$CCT_n = \left(\frac{CCT_S}{CCT_H - CCT_L}\right),$$

wherein $CCT_L$ denotes the low CCT boundary value and $CCT_H$ denotes the high CCT boundary value.

4. The method of claim 1 wherein a parametric representation of the function model comprises $$CCT_f(CCT_n) = \frac{c1 * CCT_n^{c2}}{1 + (c1 - 1) * CCT_n^{c2}} * 4096 + 5{,}421,$$

wherein, $CCT_n$ denotes the normalizing CCT value, $CCT_f$ ($CCT_n$) denotes the preferred gray CCT value, c1=14.4492 and c2=5.3723.

5. The method of claim 1, wherein generating the adjusted CCT value ($CCT_a$) comprises computing $$CCT_a = CCT_f(CCT_n) - CCT_f(6{,}504) + 6{,}504,$$

wherein $CCT_f(x)$ denotes the output of the function model for an input CCT value x, and $CC_n$ denotes the normalized CCT value.

6. The method of claim 1, wherein generating the diagonal transformation matrix comprises computing $$\alpha = [\text{L of } CCT_a]/[\text{L of D65}]$$

$$\beta = [\text{M of } CCT_a]/[\text{M of D65}],$$

$$\gamma = [\text{S of } CCT_a)]/[\text{S of D65}]$$

wherein $CCT_a$ denotes the adjusted CCT value, and α, β, and γ denote the elements of the diagonal transformation matrix.

7. The method of any of the previous claims claim 1, further comprising:

filtering adjusted CCT values with a low-pass filter to generate filtered CCT values and generating the diagonal transformation matrix based on the filtered CCT values.

8. The method of claim 1, further comprising generating a blended CCT value based on the adjusted CCT value, a source-viewing angle (SVA), a target-viewing angle (TVA), and a blending parameter $\alpha_b$ in [0,1];

and generating the diagonal transformation matrix based on the blended CCT value.

9. The method of claim 8, wherein generating the blended CCT value ($CCT_B$) comprises computing $$\text{if SVA<TVS}$$

$$CCT_B = CCT_a * \alpha_b + CCT_{source} * (1 - \alpha_b),$$

else $$CCT_B = CCT_a * \alpha_b + CCT_{D65} * (1 - \alpha_b)$$

wherein $CCT_{source}$ denotes a CCT value based on the input image data and $CCT_{D65}$ denotes the CCT value of D65, 6,504 K.

10. The method of claim 1, the method further comprising:

for a tone mapping function mapping the input image data in a source dynamic range [Smin, Smax] to a target display with a target dynamic range [Tmin, Tmax], generating an adjusted Tmax (newTmax) value comprises:

$$\text{ratio} = RGBtoXYZ_{Target} * RGBtoXYZ_{Display}^{-1}$$

$$percChange = \frac{\text{ratio}}{\max(\text{ratio})} * RGBtoY_{Target},$$

$$newT\max = percChange * T\max,$$

wherein, $RGBtoXYZ_{Target}$ denotes a 3×3 phosphor matrix constructed from red, green, blue, and white primaries of a target white point based on the adjusted CCT value, $RGBtoXYZ_{Display}$ denotes a 3×3 phosphor matrix constructed from the target display primaries, max(ratio) denotes the maximum value of the diagonal in the ratio matrix, and $RGBtoY_{Target}$ denotes Y values of the $RGBtoXYZ_{Target}$ matrix.

11. The method of claim 10, wherein generating the adjusted Tmax (newTmax) value comprises $$\text{ratio} = RGBtoXYZ_{Target} * RGBtoXYZ^{-1}_{Display}$$

$$percChange = \frac{\text{ratio}}{\max(\text{ratio})} * RGBtoY_{Target},$$

$$\text{if } percChange < \frac{S\max}{T\max}$$

$$percChange = 1$$

$$newT\max = percChange * T\max.$$

12. A non-transitory computer-readable storage medium having stored thereon computer-executable instructions for executing with one or more processors a method in accordance with claim 1.

13. An apparatus comprising a processor and configured to perform the method recited in claim 1.

* * * * *